United States Patent [19]

Dangeleit et al.

[11] 4,202,274

[45] May 13, 1980

[54] REMOVAL APPARATUS FOR HANDLING DISCARDED END PORTIONS IN A MULTISTRAND CASTING PLANT

[75] Inventors: Siegfried Dangeleit, Krefeld; Dieter Kothe, Moers, both of Fed. Rep. of Germany

[73] Assignee: DEMAG Aktiengesellschaft, Duisburg, Fed. Rep. of Germany

[21] Appl. No.: 824,258

[22] Filed: Aug. 15, 1977

[30] Foreign Application Priority Data

Aug. 18, 1976 [DE] Fed. Rep. of Germany ..... 2637072

[51] Int. Cl.[2] ..... B61B 13/12

[52] U.S. Cl. ..... 104/165; 104/162; 104/172 B; 198/459

[58] Field of Search ..... 104/162, 165, 172 B, 104/172 S; 198/750, 459; 214/1 F, 1 BB; 414/749, 750

[56] References Cited

U.S. PATENT DOCUMENTS

| | | | |
|---|---|---|---|
| 3,720,172 | 3/1973 | Dehne | 104/172 S |
| 3,830,360 | 8/1974 | Graff et al. | 198/459 |

FOREIGN PATENT DOCUMENTS 1805239 7/1977 Fed. Rep. of Germany .

*Primary Examiner*—Richard A. Bertsch
*Assistant Examiner*—Ross Weaver
*Attorney, Agent, or Firm*—Mandeville and Schweitzer

[57] ABSTRACT

The invention refers to an apparatus for disposal of cut end portions in a multistrand casting plant, particularly in a twin strand steel slab strand casting plant, consisting of vehicles moving on a rail track in a position in the strand paths following the separating or cutting device in vertical direction and positioned between the conveyor path rollers of the parallel casting strands. Such vehicles are provided with a bearing surface for the cut end portions just below the conveyor path transport level. The rail track connects the conveyor paths of a strand with a discharge station.

7 Claims, 3 Drawing Figures

REMOVAL APPARATUS FOR HANDLING DISCARDED END PORTIONS IN A MULTISTRAND CASTING PLANT

BACKGROUND OF THE INVENTION

Undesirable cut end portions of casting strands occur at the beginning and at the end of a strand. Exceptions are intermediate sections where strand sections, which have become useless due to strand ruptures, are removed from the area of the strand casting plant. Transport of discarded end portions does not take place via the usual route used for transporting cast strand material. The apparatus for removal of end portions consists of a transverse removal apparatus. The start of casting operations in multi-strand casting plants results, upon separating the initiation strand from the casting strand, in end portions which are sometimes fused with a portion of the beginning strand head. With the exception of minor time differentials, all end portions of all casting paths or veins of one multi-strand casting plant arrive simultaneously at a transverse transport apparatus area. Transport devices known from rolling mill operation are generally not applicable, as end portions in strand casting plants have considerably higher weights. End portions in strand casting plants may weigh up to 3 tons and more.

It is known in German disclosure No. 1.805.239 to push not only end portions, but normal strand sections as well, individually or together across several parallel conveyors onto a cooling bed, by means of a straightedge extending over several conveyor path rollers in longitudinal direction of the casting veins, and moving in transverse direction to the course of the strand. This type of apparatus is too involved for the removal of end portions. Furthermore, the sliding path of the straightedge increases unfavorably with an increasing number of strand veins.

STATEMENT OF THE INVENTION

The present invention is based on a track rail, space-saving in comparison, proceeding between two sets of conveyor path rollers, each for a strand vein. Practice has shown that there is no room between the strand veins of a multi-strand casting plant for several power transmission devices, each coordinated with a vehicle and a rail track for each strand. The space required by the discharge station is another problem. So far, the initially mentioned apparatus has been applied to single strand casting plants only.

The present invention relates to the previously mentioned apparatus of a vehicle for the transport of end portions on a rail track in a manner suited for multi-strand casting plants. Within this framework, the invention is directed to the power driving transmission problem resulting from the use of several vehicles, as well as to the question of a space-saving arrangement for such movement. The invention solves this by coordinating each casting strand vein or path with one car, by providing that all cars travel on one single track, by providing one single power source or transmission for all cars, by transmitting the power of the transmission onto one of the cars only, which pulls in one direction and pushes in the opposite direction, and by having the cars which are connected via tractive devices, travel in the traction course at a distance of two adjacent casting strand veins, and in the push direction joined closely together. The advantages of the invention consist in the saving of several transmissions for several cars, saving of rail track in the discharge station area, and a spacing-saving arrangement in joining the cars in the discharge station area.

Depending upon the length of the rail track resulting from the number of casting strand veins or paths, it is furthermore provided that the drive transmission consists of a reversibly driven winding barrel with rotary drive, that the drive rope or chain leads via a guide pulley, and that the beginning and the end of the tension rope are attached to the car being driven. Favorably, this type of drive transmission is arranged on either side of the group of conveyor paths, or below the conveyor paths in the foundation of the strand casting plant. In the drive transmission of the invention, the winding barrel may be arranged with the rotary drive at the end of the rail track next to the discharge station.

Space can be saved, and, given the width of the strand casting plant, this is rather important in that the drive transmission for a twin strand plant is essentially arranged at the distance of one car length next to the discharge station at one end of the rail track, and the guide pulley therefor at the other end of the rail track. The connection between cars for both travel directions of the cars is made by providing as the tractive means tie rods which are hinged at one car and attached to the adjacent car so that they can be engaged or disengaged, whereby the cars are maintained engaged at a distance of two adjacent casting strand veins in the pulling direction. Furthermore, the tractive force between two cars can be transmitted via the tie rods in such a manner that the clutch for the tie rod consists of a hooked tie rod head moving in a slot-shaped guide of a pulled car, closed while in pulling direction. Such car can be used in pushing direction without using this tie rod. This slot-shaped guide may be provided, in accordance herewith, in a protected, space-saving arrangement, where the guide of a car is arranged below the chassis between the wheel pairs, and extends in longitudinal direction of the car.

In those instances where the cars are not supposed to touch in pushing direction, the tie rod is simultaneously designed as a thrust rod, that the slot-shaped guide is closed in pushing direction, and that the rod head rests at the end of the guide in travel direction when the cars are joined, leaving only a minor clearance.

An example of the invention is schematically shown on the drawings and explained as follows:

DETAILED DESCRIPTION OF THE INVENTION

Figures 1, 2, 3:
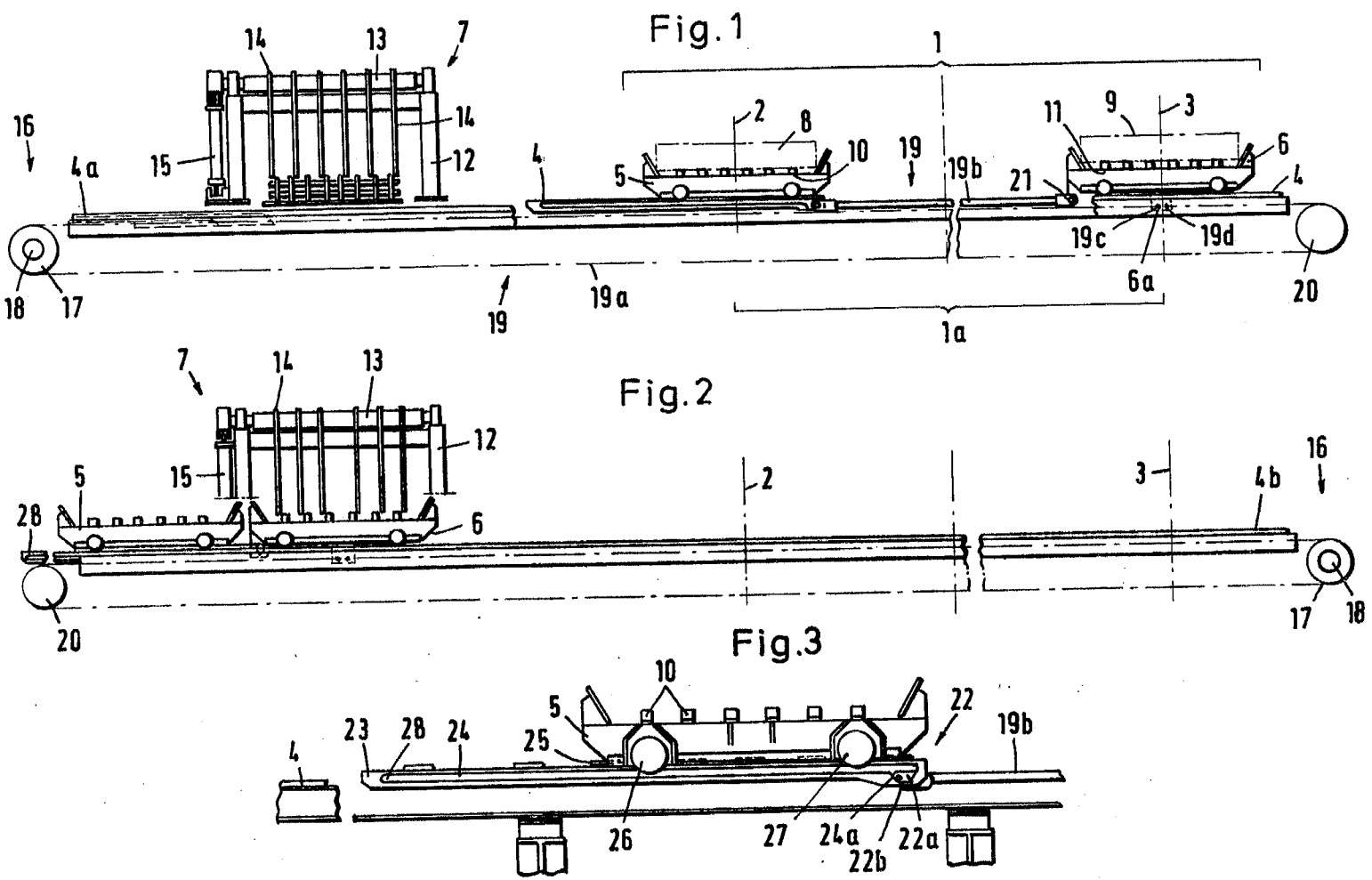
FIG. 1 is a schematic side elevational view of apparatus illustrating the invention, as viewed looking upstream in a multi-strand casting plant with two strand paths, and with vehicles in the position for receiving cut ends in the strand paths.
FIG. 2 is the same view as FIG. 1, but with the vehicles positioned adjacent the discharge station.
FIG. 3 is a partial showing of the apparatus in FIG. 1, and enlarged to show the details of the drive connection for the driven vehicles of the invention.

The multi-strand casting plant extends over area 1 containing casting strand veins 2 and 3 with spacing 1*a* between the centers of the veins. The pertaining conveyor paths and/or oxyacetylene cutting equipment are not drawn for reasons of clarity. Rail track 4 runs transversely of the two conveyor path rollers, each of a casting strand vein on one level, i.e. from the position shown of cars 5 and 6 up to discharge station 7 (FIG. 1).

The bearing surface for end portions 8 and 9 consists of bearing grates 10 and 11 respectively, which are lower by a certain amount than the conveyor path transport level formed by the top line of contact of the conveyor path rollers. The height differential between conveyor path transport level, and bearing grates 10 or 11 must be selected so that end portions 8 and 9 perform a tilting movement onto bearing grates 10 and 11 without causing damage to cars 5 or 6 by strong shocks or vibrations.

Discharge station 7 consists of a frame 12 complete with rotating traverse 13. Several levers 14 are distributed on traverse 13 spaced roughly the length of the largest end portions which match the greatest strand width feasible in the strand casting plant. A rotating motion of levers 14 vertical to the plane of the drawing can be brought about by rotating traverse 13 by means of the piston of hydraulic cylinder 15. Depending upon the rotating direction the end portion is pushed into scrap containers (not shown) arranged in front or to the rear of discharge station 7 in the rotating direction of levers 14.

The single drive transmission 16 in the invention is arranged, in accordance with FIG. 1, at the left end 4*a* of rail track 4 or, in accordance with FIG. 2, alternatively at the right end 4*b* of rail track 4. The drive transmission 16 consists of winding barrel 17 whose rotary drive 18 is represented symbolically by darkened panels of the winding barrel shaft, as well as several means of traction or connection 19. Traction device 19 between winding barrel 17 and guide pulley 20 consists of traction rope 19*a* and traction tie rod 19*b* between cars 5 and 6. Driven car 6 has projection 6*a* to fasten traction rope end 19*c* and traction rope end 19*d*. Depending upon turning direction of rotary drive 18, the driven car 6 is pulled from left to right (FIG. 1) or from right to left. The movement of car 6 from left to right is called "pulling direction" herein and the movement from right to left is called "pushing direction" herein. For the travel ending in the position as shown in FIG. 1, tie rods 19*b* act as traction devices 19. Tie rod 19*b* is attached to car 6 via joint 21. At the other end, the tie rod forms a clutch 22 (FIG. 3) consisting of tie rod head 22*a* developed in the shape of a hook by means of cam 22*b*. In pulling direction, cam 22*b* carries car 5 along on frame 23 which comes with a slot-shaped guide 24. The slot-shaped guide 24 is closed at one end for reasons of power transmission. Frame 23 is located below chasis 25 of car 5 between wheel pairs 26 and 27, and forms a rigid unit with the latter.

In pushing direction, cam 22*b* bears against an inclined curve of cam piece 24*a*, slides into guide 24 through car 6 up to the closed end 28 (FIGS. 2 and 3) and drives car 5. The length of tie rod 19*b*, acting as a thrust rod, is calculated so that a residual clearance remains between cars 5 and 6 as shown in FIG. 2. The invention can be realized without tie rod 19*b* as well. Tie rod 19*b* can be replaced by a flexible means of traction which, in pushing direction, has a slack hanging into a channel which is to be kept open at the bottom and which extends in the direction of motion. In this case, the cars touch at the bumpers on spacers provided for this purpose.

While FIG. 1 shows the position of the cars at the moment of pick-up of the end portions, FIG. 2 shows the cars in the discharge station 7. Car 5 was already unloaded during the unloading phase. This was done by charging the piston in hydraulic cylinder 15 in order to cause rotation of traverse 13 with levers 14 and to push end portion 8 off car 5 by means of the rotating motion vertical to the plane of the drawing. Then, car 5 was pushed into the position shown by means of car 6, so that car 5 reaches a point on rail track 4 between drive transmission 20 and the discharge station. It is advantageous to dimension this rail section for the example shown in accordance with approximately one car length, occupying little space relative to the width of a multi-strand casting plant. In this phase, car 6 is in discharge position, whereby once more the operation of hydraulic cylinder 15, as already described, results in dropping of end portion 9. The invention has particular advantage when applied to strand casting plants of two to six casting veins.

We claim:

1. In apparatus for removing unwanted cut ends of the cast strands in a multi-strand casting plant, and having (a) a plurality of cast strand paths;
(b) a wheeled vehicle in each cast strand path for receiving said cut ends;
(c) each said vehicle having a bearing surface positioned in its respective strand path downstream of cutters for receiving the cut ends, dropped from the strand path with each said bearing surface below the bottom edge of the strand path;
(d) a single discharge station positioned at one side of said bearing surfaces;
(e) a dual rail connecting said strand paths with said discharge station, said dual rail extending transversely of said strand paths; the improvement characterized by
(f) said dual rail being a single rail path;
(g) said wheeled vehicles positioned in said single rail path, with one vehicle for each strand path;
(h) a single power means in said rail path;
(i) said single power means connected to only one of said vehicles;
(j) said power connected vehicle pulling said other vehicles in one direction of travel on said rail;
(k) tractive connection means connecting said power connected vehicle with said other vehicles;
(l) said tractive connection means including
  (1) a tie rod,
  (2) each said tie rod pivotally connected at one end to one of said vehicles,
  (3) each said tie rod is of a length to maintain said spacing distance as measured between the center of adjacent strand paths,
  (4) each said tie rod and the adjacent connected vehicle having a clutch connection at the end thereof opposite said pivot connection, and
  (5) each clutch connection allowing spacing between said vehicles in the pull direction equal to the distance between the center of adjacent strand paths, and in the push direction at a distance shorter than said spacing;
(m) said clutch connection comprising
  (1) a hooked tie rod head at the end of said tie rod,
  (2) a slotted guide on said adjacent vehicle for receiving said tie rod in sliding engagement, and (3) each said slotted guide having cooperating means for engagement with said hooked tie rod head in said pulling direction of said power connected vehicle.

2. The apparatus of claim 1, further characterized by
(a) two strand paths in said multi-strand casting plant.

3. The apparatus of claim 2, further characterized by said single power means comprising
(a) a drum mounted for rotation and connected to a source of power;
(b) said rotary drum positioned at one end of said single rail means;
(c) a guide pulley positioned at the end of said single rail means opposite said drum;
(d) a drive belt extending around said guide pulley and said drum;
(e) both ends of said belt connected to said power connected vehicle; and
(f) said drum being rotatable in either direction by said power source.

4. The apparatus of claim 3, further characterized by
(a) said drum positioned at the end of said rail means adjacent said discharge station.

5. The apparatus of claim 4, further characterized by
(a) said drum positioned with the associated end of said rail means transversely to the side of said discharge station opposite said multi-strand paths; and
(b) said drum spaced from said discharge station substantially the distance of one vehicle length.

6. The apparatus of claim 1, further characterized by
(a) each said slotted guide positioned on the respective said vehicle longitudinally thereof; and
(b) each said guide suspended on the bottom of the respective said vehicle chassis.

7. In apparatus for removing unwanted cut ends of the cast strands in a multi-strand casting plant, and having
(a) a plurality of cast strand paths;
(b) a vehicle in each cast strand path for receiving said cut ends;
(c) each said vehicle having a bearing surface positioned in its respective strand path downstream of cutters for the cut ends, with each said bearing surface below the bottom edge of the strand path;
(d) a single discharge station positioned at one side of said bearing surfaces;
(e) rail means connecting said strand paths with said discharge station, said rail means extending transversely of said strand paths; the improvement characterized by
(f) said rail means being a single rail path;
(g) said vehicles positioned in said single rail path, with one vehicle for each strand path;
(h) a single power means in said rail means;
(i) said single power means connected to only one of said vehicles;
(j) said power connected vehicle pulling said other vehicles in one direction of travel on said rail means,
(k) tractive connection means connecting said power connected vehicle with said other vehicles;
(l) said tractive connection means including
(1) a tie rod,
(2) each said tie rod pivotally connected at one end to one of said vehicles,
(3) each said tie rod is of a length to maintain said spacing distance as measured between the center of adjacent strand paths,
(4) each said tie rod and the adjacent connected vehicle having a clutch connection at the end thereof opposite said pivot connection; and
(m) said clutch connection comprising
(1) a hooked tie rod head at the end of said tie rod,
(2) a slotted guide on said adjacent vehicle for receiving said tie rod in sliding engagement,
(3) said slotted guide having cooperating means for engagement with said hooked tie rod head in said pulling direction of said power connected vehicle,
(4) each said slotted guide positioned on the respective said vehicle longitudinally thereof,
(5) each said guide suspended on the bottom of the respective said vehicle chassis,
(6) cooperating cam means on each said slotted guide and said hooked tie rod head in said pushing direction of said power connected vehicle,
(7) said cooperating cam means causing said tie rod to be received in said slot, and
(8) said slot closed at the end thereof opposite said cam means to form a stop for said tie rod in said slotted guide in said pushing direction.

* * * * *